US006148593A

United States Patent [19]

Heinsey et al.

[11] Patent Number: 6,148,593

[45] Date of Patent: Nov. 21, 2000

[54] MULTIFUNCTIONAL HANDLE FOR CONTROLLING AN AGRICULTURAL COMBINE

[75] Inventors: David N. Heinsey, Stevens; Richard P. Strosser, Akron; Dwayne B. Smith, Lancaster, all of Pa.

[73] Assignee: New Holland North America, Inc., New Holland, Pa.

[21] Appl. No.: 09/289,872

[22] Filed: Apr. 12, 1999

Related U.S. Application Data

[60] Provisional application No. 60/089,652, Jun. 17, 1998.

[51] Int. Cl.[7] ..... G05G 9/047

[52] U.S. Cl. ..... 56/10.2 R; 56/1; 701/50

[58] Field of Search ..... 56/1, 10.2 R; 37/348, 37/466; 172/2, 3; 701/50

[56] References Cited

U.S. PATENT DOCUMENTS

| | | | |
|---|---|---|---|
| 4,012,014 | 3/1977 | Marshall | 244/83 F |
| 4,332,261 | 6/1982 | De Busscher | 130/27 P |
| 4,522,553 | 6/1985 | Nelson et al. | 414/526 |
| 4,574,651 | 3/1986 | Nordstrom | 74/471 XY |
| 4,641,857 | 2/1987 | Gailiunas | 280/821 |
| 4,738,417 | 4/1988 | Wenger | 244/234 |
| 4,800,711 | 1/1989 | Hurlburt et al. | 56/219 |
| 4,836,544 | 6/1989 | Lai | 273/73 J |
| 4,846,198 | 7/1989 | Carnewal et al. | 460/21 |
| 4,862,165 | 8/1989 | Gart | 341/20 |
| 4,866,920 | 9/1989 | Kerckhove et al. | 56/16.6 |
| 4,907,402 | 3/1990 | Pakosh | 56/14.6 |
| 4,967,544 | 11/1990 | Ziegler et al. | 56/10.2 |
| 5,042,314 | 8/1991 | Rytter et al. | 74/335 |
| 5,155,984 | 10/1992 | Sheehan | 56/10.2 |
| 5,332,322 | 7/1994 | Gambaro | 400/489 |
| 5,340,067 | 8/1994 | Martin et al. | 248/118.5 |
| 5,472,156 | 12/1995 | Bivens, III et al. | 244/234 |
| 5,503,040 | 4/1996 | Wright | 74/471 |
| 5,566,586 | 10/1996 | Lauer et al. | 74/523 |
| 5,577,417 | 11/1996 | Fournier | 74/523 |
| 5,666,793 | 9/1997 | Bottinger | 56/10.2 R |
| 5,768,947 | 6/1998 | Fee et al. | 74/523 |
| 5,978,720 | 11/1999 | Hieronymus et al. | 701/29 |
| 5,992,260 | 11/1999 | Fujiki et al. | 74/469 |
| 6,001,015 | 12/1999 | Nishiumi et al. | 463/38 |
| 6,061,617 | 5/2000 | Berger et al. | 701/50 |

*Primary Examiner*—Thomas B. Will
*Assistant Examiner*—Nathan Mammen
*Attorney, Agent, or Firm*—J. William Stader; Larry W. Miller

[57] ABSTRACT

The device is a multifunctional handle for controlling an agricultural combine. The device consists of palm grip with a finger rest. Attached to the palm grip is a crescent control region. The crescent control region has an upper control area and a lower control area separated by a thumb rest area. The control areas have various controls arranged by usage. The control areas are stepped from the thumb rest area so as to allow the operator to tactilely sense the position of his right thumb relative to the control areas. The palm grip and finger rest are tapered so as to be ergonometrically comfortable for the operator's arm.

17 Claims, 5 Drawing Sheets

MULTIFUNCTIONAL HANDLE FOR CONTROLLING AN AGRICULTURAL COMBINE

CROSS-REFERENCE TO RELATED APPLICATIONS

This application claims domestic priority on U.S. Provisional Patent Application Serial No. 60/089,652, filed on Jun. 17, 1998.

BACKGROUND OF INVENTION

1. Field of Art

This invention relates to the improvement of an agricultural combine. More specifically it relates to an improvement of the multifunctional handle for controlling an agricultural combine.

2. Description of Prior Art

Mechanical harvesting of grain has taken place for decades. However, efforts continue in the attempt to make harvesting operations more efficient and effective. A combine harvester generally includes a header which cuts the crop. The header then moves the cut crop into a feeder house. The feeder house lifts the cut crop into the threshing and separation areas of the combine. The grain is separated from the stalk by a rotor or threshing system. The grain is then moved and stored in a grain tank. The chaff and trash are deposited from the rear of the combine. The grain stored in the grain tank is eventually discharged through a grain tank unload tube. An operator usually runs these various operations from a glass-enclosed cab. Typically, the cab is located above and behind the header. There are a variety of agricultural combine harvesters and their operations are well known in the art. For examples of such harvesters, reference U.S. Pat. No. 4,846,198 which illustrates the conventional and twin rotor threshing and separating systems of a harvester as well as other major systems of the harvester. U.S. Pat. No. 4,332,262 also illustrates the primary systems of a conventional harvester. For further details regarding various agricultural harvester systems review U.S. Pat. Nos. 4,522,553, 4,800,711, 4,866,920, 4,907,402, 4,967,544 and 5,155,984. As previously described the operator sits in a chair within the cab of harvester. Usually there is a control console positioned to the right side of the operator. Typically the operator's right hand controls a variety of the harvester's systems. During harvesting periods it is not uncommon for the combine harvester to be operated for an extended time. Sometimes a single operator will use a combine for 16 to 18 hours a day. Furthermore, several operators may alternate in the use of the combine. Therefore it is necessary to provide a control system which will allow maximum operator comfort and flexibility. This will permit the operator to remain mentally alert for the long time intervals needed to harvest crops. One aspect of maintaining the operator's alertness is to provide a multifunctional handle for controlling the harvester that is comfortable and has the controls placed in a manner to allow for easy use. The controls on the handle should be placed in such a manner to eliminate the need for the operator to be constantly looking away from the field and into the cab to view instrumentation. Ideally, the controls should be able to be reached by easy movements and by touch of either the fingers or thumb. Presently, combine harvesters use a single control stick with the great bulk of the controls positioned on the control console. The operator is constantly looking away from the field to manipulate these controls. This can become distracting and decrease the productivity of the operator.

The attempt to design a more effective control handle has followed many paths which can be illustrated by several patents. U.S. Pat. No. 4,574,651 discloses a control stick unit. This unit has a multitude of switches. Unfortunately, it would make it difficult for an operator to be able to re-position their finger or thumb correctly after moving to activate a switch. It is possible that operator could inadvertently re-position over the incorrect switch. Depending on the particular switch, this could have disastrous consequences.

U.S. Pat. No. 4,738,417 illustrates a hand operated control. The handle in this patent is more ergonometrically pleasing, however it only controls one switch.

U.S. Pat. No. 4,862,165 illustrates an controller or computer 'mouse'. This device has several curved surface and a few switches. Because of the limited number of switches, it is easy for a user to avoid getting confused while using the switches.

U.S. Pat. No. 5,042,314 discloses a steering and transmission shifting control mechanism. The control mechanism uses a single switch which is controlled by the operator's thumb. However, it could be difficult for the operator to distinguish between the various settings on the joystick. This could result in an inappropriate setting or the need for the operator to constantly view the joystick to check the settings.

U.S. Pat. No. 5,340,067 discloses a hand and wrist support for computer mouse. This represents another improvement to a computer mouse design for a computer system. Again, the controls are very limited. In this design there only appears to be one switch.

U.S. Pat. No. 5,503,040 discusses a computer interface device. The device holds the operator's fingers in position over several switches. Unfortunately this could become uncomfortable after an extended interval.

U.S. Pat. No. 5,577,417 illustrates a tactile and/or kinaesthetic manual information return control member. This device uses pressure on control member to control the various systems.

Consequently, the need exists for a multifinctional handle for controlling an agricultural combine which allows for multiple controls and which are comfortable and easy for an operator to use over a long time interval.

OBJECTS OF THE INVENTION

It is an object of the present invention to provide an improved multifunctional handle for controlling an agricultural combine.

It is a further object of the present invention to provide a multifunctional handle having a natural and comfortable rest position for the hand.

It is a further object of the present invention to provide a multifunctional handle having a plurality of controls which are easy to reach by arc movement of the thumb.

It is a further object of the present invention to provide a multifunctional handle having stepped control surfaces to allow easy locating of the various switches.

It is a further object of the present invention to provide a multifunctional handle with multiple operator controls within a small area.

It is a further object of the present invention to provide a multifunctional handle with a fixed point of reference from which to operate the controls.

It is a further object of the present invention to provide a multifunctional handle having an excellent tactile feel.

It is a further object of the present invention to provide a multifunctional handle which uses the front and back sides on the handle.

It is a further object of the present invention to provide a multifunctional handle having the switches used in the control of a agricultural combine harvester arranged in order of use.

SUMMARY OF THE INVENTION

The invention overcomes the deficiencies of the prior art. The invention is a multifinctional handle for controlling an agricultural harvester. The handle is connected by a support tube to a control console located in the right side of agricultural harvester. The handle is capable of moving relative to the control console. The handle consists of a crescent control region having an upper control area, a lower control area and a thumb rest area. There are a plurality of controls and switches located in the upper and lower control areas. During the bulk of the harvesting operations, the operator's right thumb is positioned in the thumb rest area. If the operator needs to manipulate the controls in the upper control area, the right thumb is rotated clockwise. To manipulate the controls in the lower control area, the operator rotates his thumb in a counter-clockwise fashion. Between the thumb rest and control areas, the handle is stepped to allow the operator to tactilely sense the position of his thumb in the crescent control region. The controls in each area are positioned in order of usage. The frequently used controls are positioned towards the center of the crescent control region. There is a palm grip attached to the crescent control region. Attached to the palm grip is the finger rest. At the base of the finger rest is a neutral trigger. The palm grip and finger rest are tapered so that the operator's right hand is able to remain in an ergonomically comfortable position. In an alternative embodiment, the thumb rest area is replaced with the middle control area. A set of controls in the upper control area is moved to middle control area.

BRIEF DESCRIPTION OF THE DRAWINGS

The advantages of this invention will be apparent upon consideration of the following detailed disclosure of the invention, especially when taken in conjunction with the accompanying drawings wherein.

DETAILED DESCRIPTION OF THE INVENTION

Figure 1:
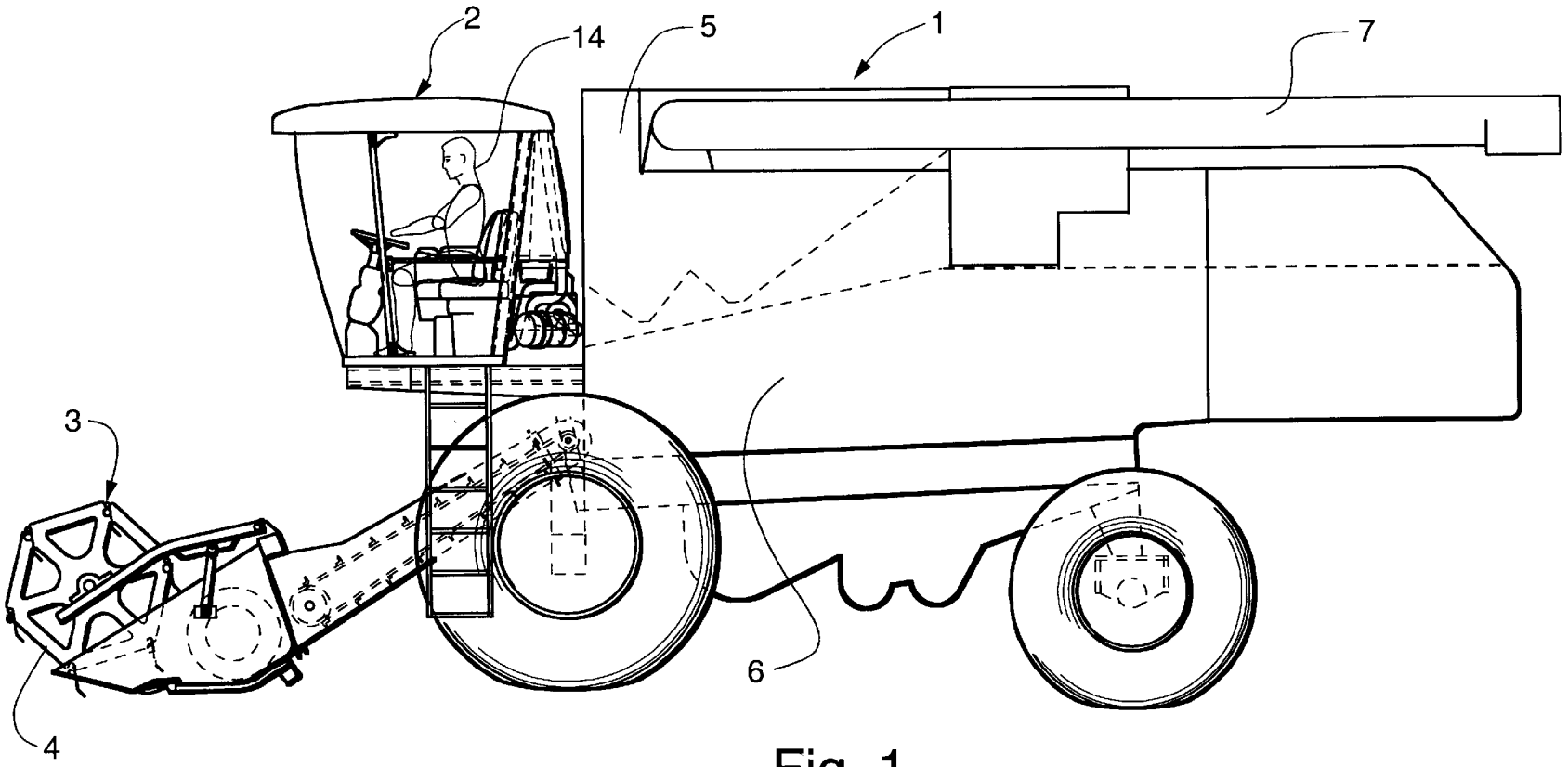
FIG. 1 is a front perspective view of an agricultural combine harvester having the multifunctional handle of the present invention.

Referring to the drawings, it is possible to observe the major elements and general operation of the present invention. Left and right references are used as a matter of convenience and are determined by standing at the rear of the combine and facing the forward end in the normal direction of travel. Likewise, forward and rearward are determined by normal direction of travel of the combine. Upward or downward orientations are relative to the ground or operating surface. Horizontal or vertical planes are also relative to ground.

Figure 2:
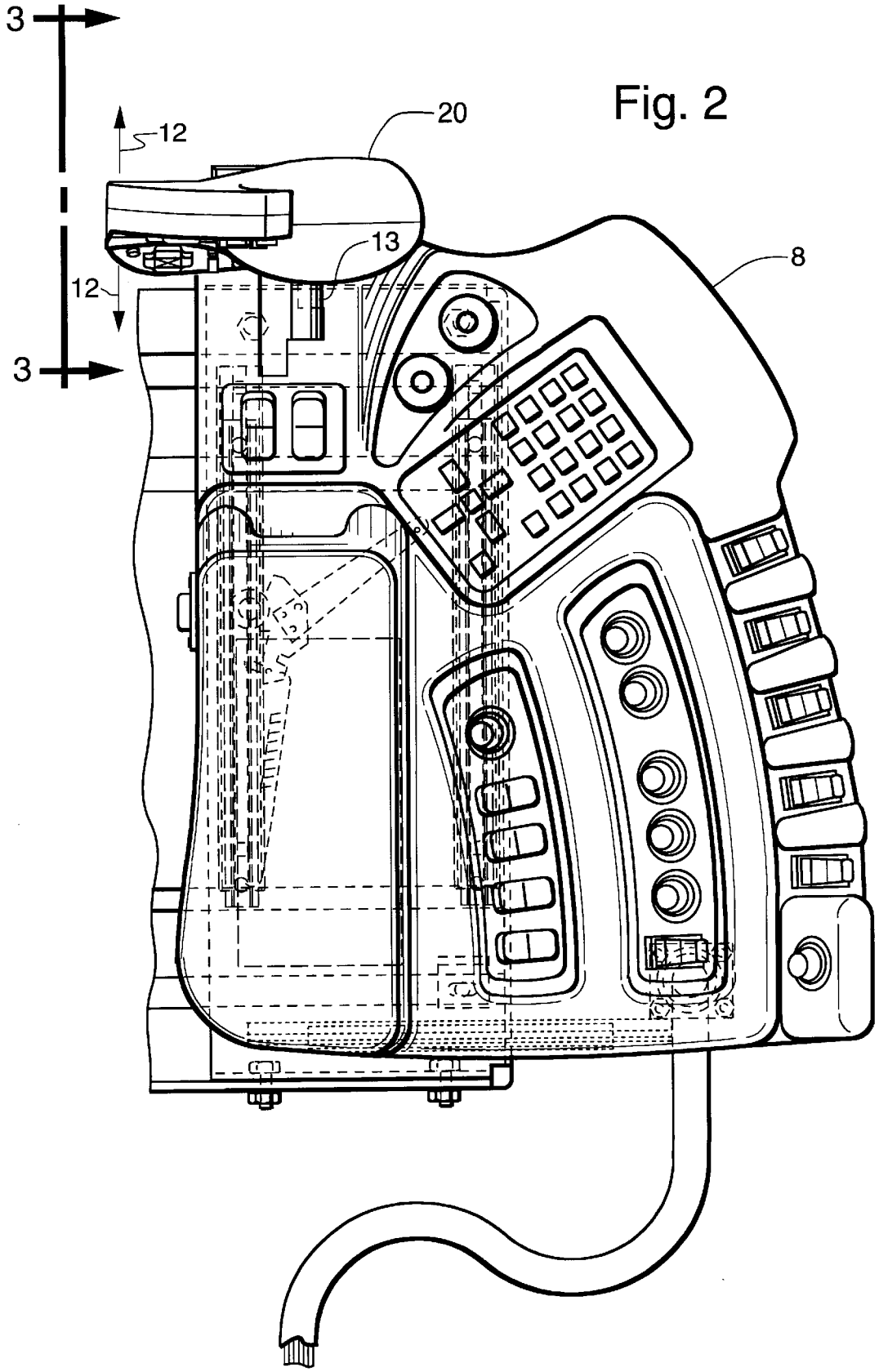
FIG. 2 is an enlarged fragmentary view of the console taken on the line 2—2 of FIG. 1 showing the multifunctional handle of this invention.

FIG. 1 illustrates a typical twin rotor combine 1 having a pair of front wheels (only one shown) and a pair of rear wheels (only one shown) for providing movement over the ground. At the front of the combine is a header 3 for cutting a crop. As the combine 1 and header 3 are moved forward, the grain and stalk are cut by the header. The header moves the grain into an auger trough. A transverse auger pushes the grain and stalk in the auger trough to the center of the header. The header illustrated in FIG. 1 is a wheat or similar small grain header. The header 3 may be positioned and re-positioned relative to the ground. The header may also be tilted to the left or right or may be positioned relatively high or low to the ground. These features are constantly being adjusted depending on the terrain and crop conditions. The header reel 4 may also be positioned relative to the header 3. The position and rotation of the header reel 4, again depends on the terrain and crop conditions. Moveable headers and header reels are well known and established in the art. Located at the center of the header is the feeder or elevator. The feeder moves the grain and stalks rearward into the threshing, separation and cleaning systems 6 of the combine. After processing and separation, the processed grain is stored in a grain tank 5 located near the top of the combine. The grain is removed from the grain tank by an unloading auger (not shown) through the grain tank unload tube 7. Usually during the harvesting operations, the unloading auger remains off and the grain tank unload tube 7 remains positioned by the grain tank 5. However, the combine can be unloaded 'on the go'. The operator is followed by a separate vehicle such as a truck or tractor-pulled grain cart. The processed grain is discharged while the combine and separate vehicle are moving. After sufficient grain has been accumulated in the grain tank 5, the operator activates the unload tube 7. The operator 14 then positions the end of the unload tube 7 over a receptacle. Unloading augers and unload auger grain tubes are well known and established in the art. The trash or chaff is ejected from the rear of the combine. The operator 14 controls the combine 1 from the cab 2 located behind the header 3 and at the front of the combine. From the cab the operator can observe most the various combine functions. The cab 2 usually has a large glass window or several windows which afford the operator the maximum ability to monitor the header 3. There is typically a control console 8 positioned at the right side of the operator 14. The control console 8 is where the operator 14 will manipulate the various control switches and devices for operating most of the systems discussed above. Most of the major systems in a combine are discussed and well known in the prior art. Incorporated by reference for detailing these systems are U.S. Pat. Nos. 4,332,262 and 4,846,198. The present invention is a multifunctional handle 20 for controlling an agricultural combine. The handle 20 is positioned within the cab 2. The handle 20 is attached to the control console 8 (as seen in FIG. 2) to the right of the operator 14. By pushing the handle 20 forward or pulling the handle 20 rearward, the operator can vary the speed of the combine. By continuing to pull the handle 20 rearward, the combine can be reversed from a forward direction to a rearward direction by means of a hydrostatic drive. Again, this feature is well established on a combine such as the New Holland TR 88, twin rotor combine. The multifinctional handle 20 also contains several switches and controls which may be manipulated by the operator 14 without requiring that the operator 14 constantly be looking down at the control console 8 or at the multifunctional handle 20. If the operator must constantly be reviewing the controls, then the operator 14 is prevented from vigilantly observing the crop and terrain conditions. This results in the operator working at a slower speed or risk damaging the equipment on the combine. A multifunction handle 20, containing the critical switches, that is designed in a manner so the operator is capable of knowing the position of his thumb and fingers without visual cues would represent a great improvement in the art. The present multifinctional handle 20 accomplishes this by means of a crescent control region 40 positioned proximal to ergonomically advantageously designed palm grip 30 and finger rest 35. Spaced on the crescent control region 40 are several controls and switches which can be manipulated by the operator's right thumb 11 rotating either clockwise 70 or counter-clock wise 71.

Figure 3:
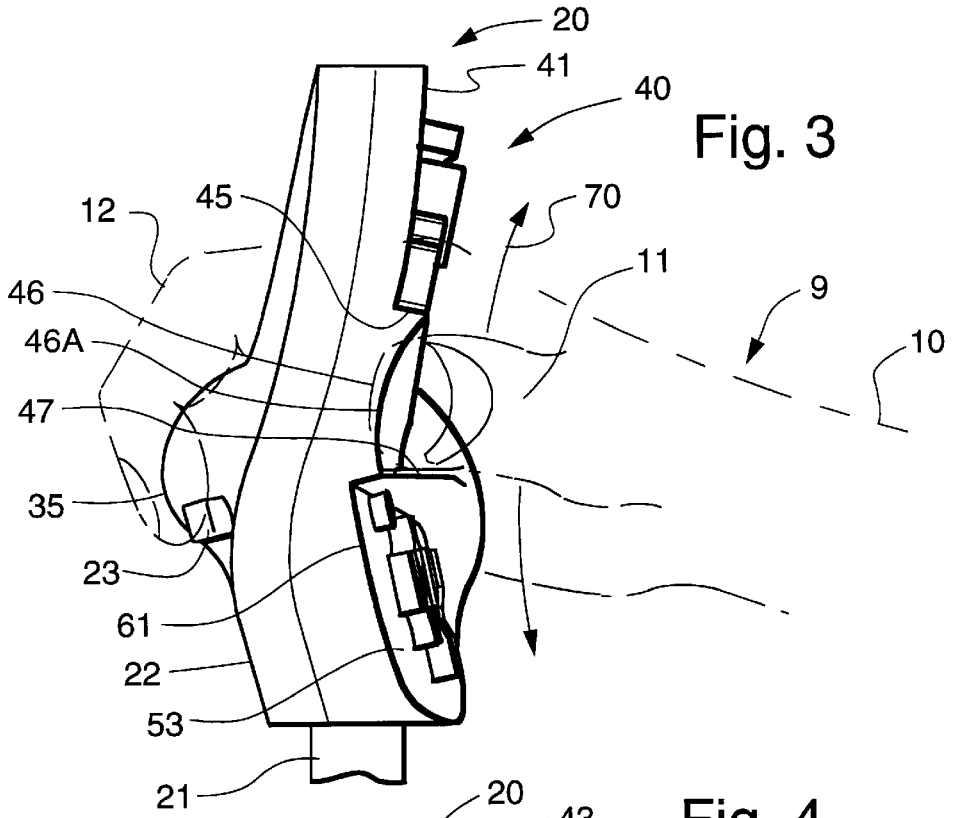
FIG. 3 is an enlarged side elevation of the handle as seen from the line 3—3 of FIG. 2 showing the relationship between the multifinctional handle and the hand of an operator.
Figure 4:
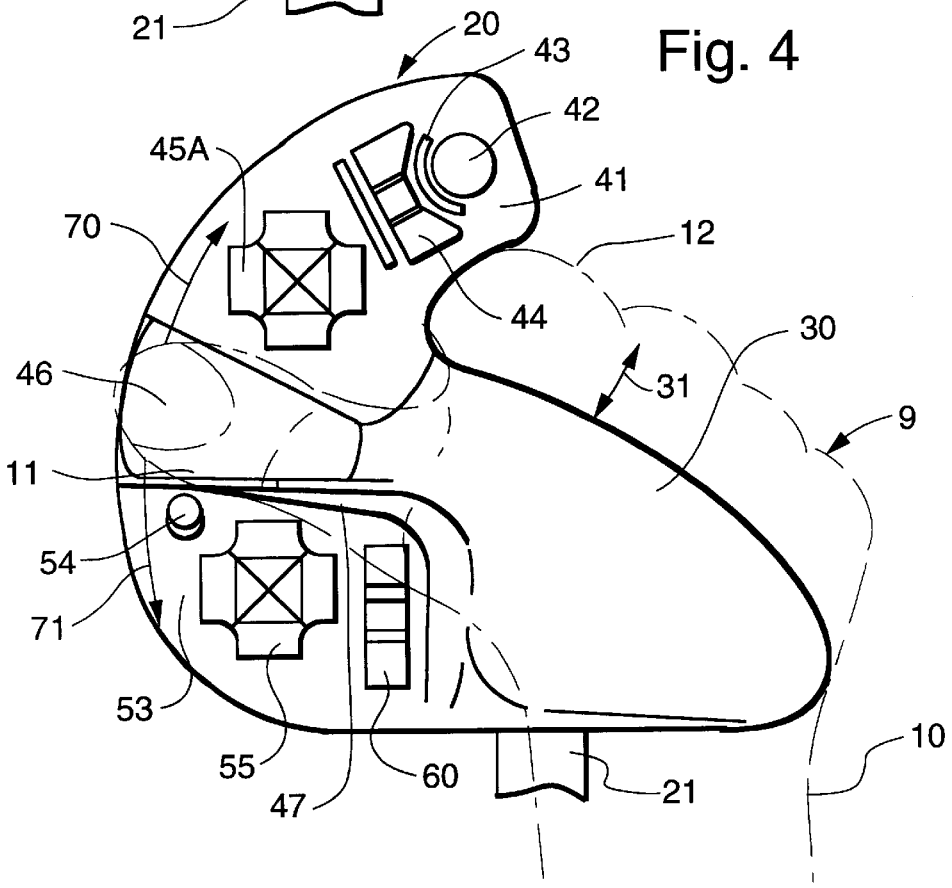
FIG. 4 is a rear elevation view of the multifunctional handle of FIG. 3.
Figure 7:
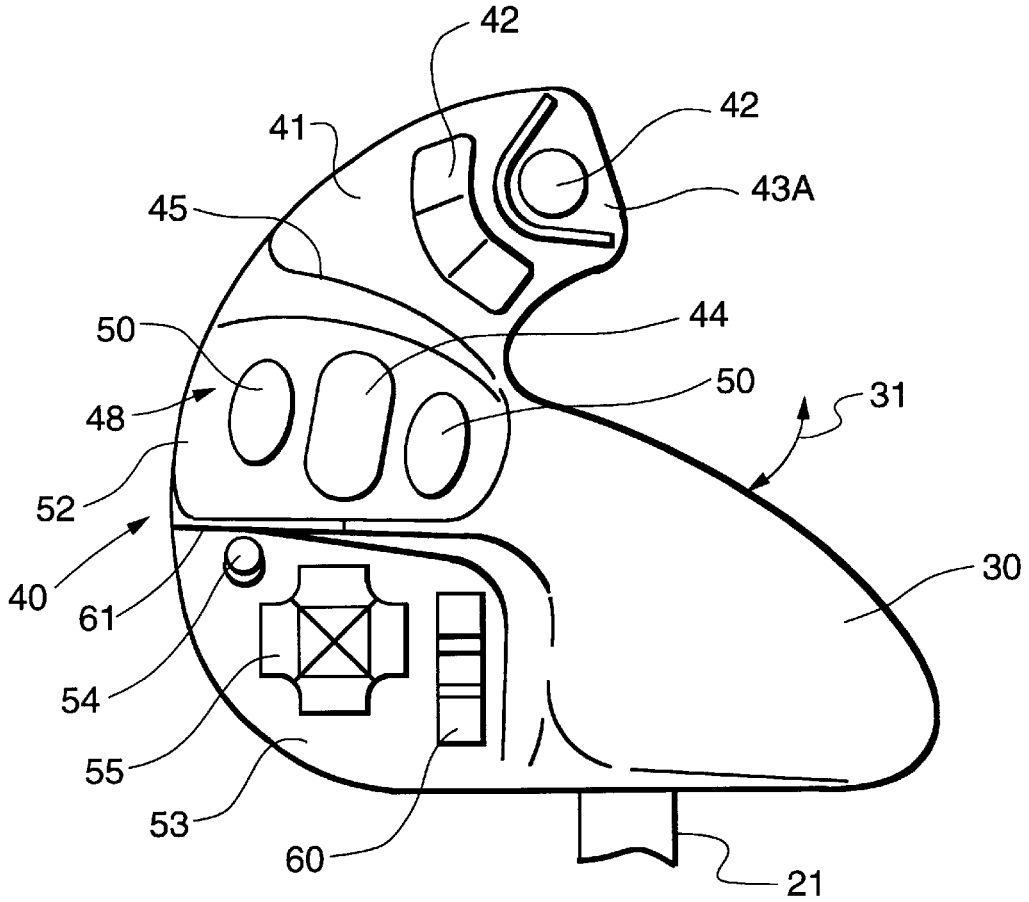
FIG. 7 is a rear elevation view of an alternate layout of crescent control area of the multifunctional handle.

Now that the general elements have been reviewed, it is possible to review the more specific aspects of the present invention. The multifinctional handle 20 consists of a crescent control region 40. In the preferred embodiment, as illustrated in FIGS. 3 and 4, the crescent control region has two control areas and a thumb rest area 46. The upper control area 41 has three switches. There is the unload tube switch 42. The unload tube switch 42 engages the unload auger within the unload tube 7. The unload tube switch 42 is electrically linked to the controller for this system in a conventional manner. In order to prevent the operator's right thumb 11 from accidentally contacting the unload tube switch 42, there is an unload tube switch guard means protecting the unload tube switch 42. In the preferred embodiment, as seen in FIG. 4, the unload tube switch guard means consists of a unload tube switch ridge 43. Another embodiment of the switch guard means, as seen in FIG. 7, consists of a unload tube switch bevelled region 43A. This region 43A surrounds the unload tube switch 42 and necessitates the operator's right thumb 12 to carefully contact the switch 42 while avoiding contact with the bevelled region 43A. It is necessary to add the switch guard means to protect the unload tube switch 42 from inadvertent activation. Improper activation of this switch 42 could result in crop being discharged at the wrong moment from the grain tank. Besides the unload tube switch 42, the upper control area also has the unload tube movement control switch 44. The movement control switch 44 controls the motion of the unload tube 7 away and towards the combine. The switch 44 is electrically linked in a conventional manner to the controller of unload tube 7. Finally, there is the four-way header control switch 45A. This switch 45A moves the header upwards, downwards, tilt left and tilt right. Again, the header control switch 45A is electrically linked in a conventional manner to the controller on the header control system. These three switches—the unload tube switch 42, the unload tube movement control switch 44 and the four-way header control switch 45A are positioned in the order of their usage. The least used switch, the unload tube engagement switch 42, is positioned highest and furthest away from the middle of the crescent control region 40. Conversely, the four-way header control switch 45A is usually being constantly manipulated by the operator so it is positioned closer the middle of the crescent control region 40.

Separating the upper control area 41 from the thumb rest area 46 is the upper step 45. The upper step 45 is a slight rise from the upper control area 41 to the thumb rest area 46. The upper step 45 is 'stepped' sufficiently to allow the operator's right thumb 11 to tactilely sense the difference between the upper control area 41 and thumb rest area 46. The thumb rest area 46 has a curvature 46A and a thumb ledge 47. These features help the operator orient his right thumb 11 by tactilely sensing the thumb's position. The curvature 46A and thumb ledge 47 also provide for a comfortable base position for the right thumb 11 to rest between tasks.

Between the thumb rest area 46 and lower control area 53 is the lower step 61. Similar to the upper step 45, the lower step 61 has a slight depression from the lower control area 53 and thumb rest area 46. Again the lower step 61 is 'stepped' sufficiently to allow the operator's right thumb 11 to tactilely sense that the thumb has left the thumb rest area 46 and has moved into the lower control area 53. The lower control area 53 has three switches—the header resume switch 54, the reel control four-way switch 55 and the reel speed switch 60. The header resume switch 54 is used to raise the header out of the crop and when depressed again will lower the header back to the position the header was in when it left the crops. The operator can then quickly lower the header 3 after a turn is made and the operator is ready to resume harvesting operations. The header resume switch 54 is electrically linked to the header controller in a conventional manner. The reel control four-way switch 55 adjusts the position of the reel relative to the header 3. The switch moves the reel up, down, forward and rearwards relative the header 3. The reel control four-way switch 55 is electrically linked to the reel controller in a conventional manner. The reel speed switch 60 adjusts the rotational speed of the header reel 4. Again, the reel speed switch 60 is electrically linked to the reel speed controller in a convention manner. Similar to the upper control area 41, the lower control area switches are positioned in order of their usage. The reel speed control switch 60 is used the least so it is positioned farthest from the middle of the crescent control region 40. The header resume switch 54 is used the most so it is the closest to the middle of the crescent control region 40.

In an alternate embodiment (as seen in FIG. 7), the thumb rest area 46 is replaced with a middle control area 48 and the four-way header control switch 45A in the upper control area 41 is removed. The functions of the four-way header control switch 45A is provided by three switches in the middle control area 48. The three switches consist of the header raise/lower switch 49, the header lateral float switch-counter-clockwise motion 50 and the header lateral float switch-clockwise motion 51. These three switches are electrically linked to the header control system in a conventional manner. In the center of the header raise/lower switch 49 is a dimple 52. The dimple is designed to be tactilely sensed by the operator's right thumb 11. This allows the operator to be aware of the position of his thumb relative to the various controls on the multifinctional handle 20.

Figure 5:
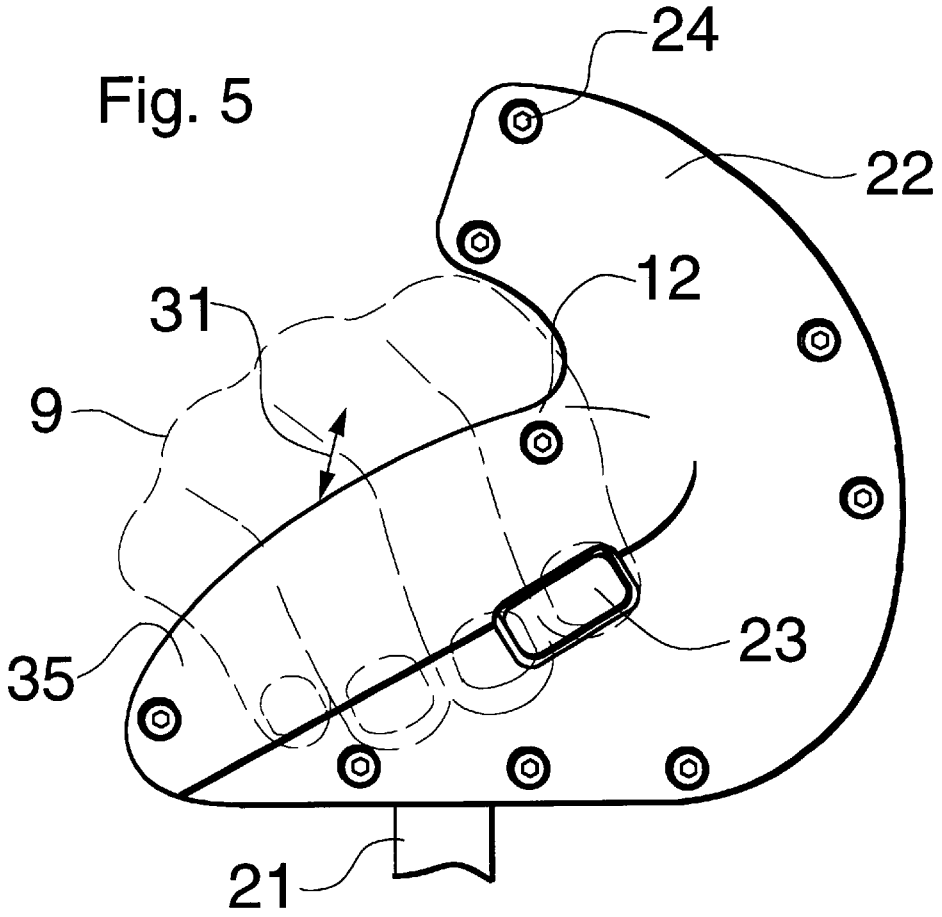
FIG. 5 is a front elevation view of the multifunctional handle of FIG. 3.
Figure 6:
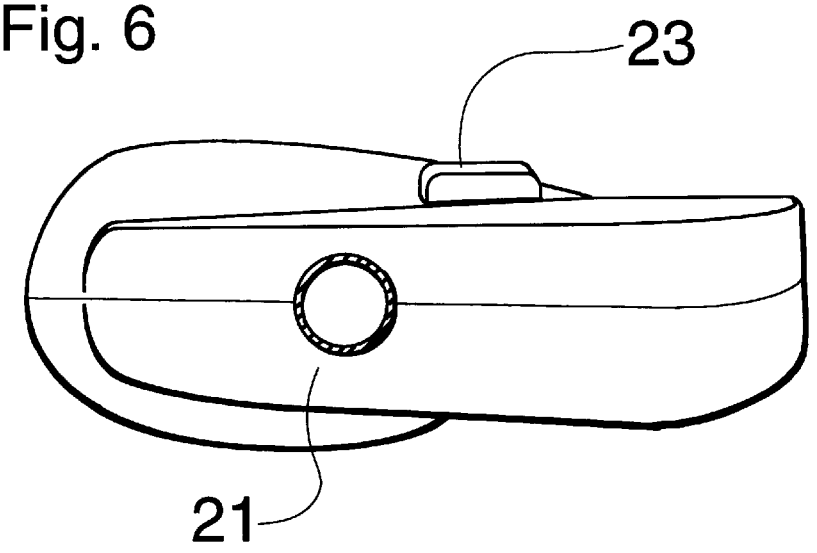
FIG. 6 is a bottom view of the multifinctional handle.

Affixed to the crescent control region is the palm grip 30. At the top of the palm grip 30 and extending to the rear side 22 of the multifunctional handle 20 is the finger rest 35. As seen in FIGS. 4, 5 and 7 the palm grip 30 and finger rest 35 gradually taper 31 from the horizon in a range from 30 to 45 degrees. This allows the operator to maintain the position of his wrist 10 and right hand 10 at a natural, ergonomically comfortable position. On the rear side 22 near the base of the finger rest 35 is the neutral trigger 23. The neutral trigger 23 is controlled by the operator's right fore finger 12. The neutral trigger is a conventional mechanical switch which the operator activates when it is desired to move the combine from forward motion to reverse motion. Also seen in FIG. 5, on the rear side 22 of the handle 20 are a series of attachment bolts 24 for holding the rear side 22 to the remainder of the handle 20. The palm grip 30 is connected by the control console 8 by a support tube 21.

In typical operations, the operator 14 will have his right hand 9 with the palm on the palm grip 30. The operator's right fingers will lay over the finger grip 35. The entire handle 20 can be moved 72 to the relative control console 8 by the operator pushing the palm grip 30 or pulling the finger rest 35. The operator's right fore finger 12 engages the neutral trigger 23 if it is desired to change the direction of the combine 1. During most of the harvesting operation the operator's right thumb 11 remains on the thumb rest area 46 in the curvature 46A or on the thumb ledge 47 in the crescent control region 40. When the need arises for the operator to manipulate the controls in the upper control area 41, the operator rotates his right thumb 11 clockwise 70 to engage those switches. Conversely when the operator needs to engage switches on the lower control area 53, he rotates his thumb 11 counter-clockwise 71.

It will be obvious to those skilled in the art that various changes may be made without departing from the scope of the invention and the invention is not to be considered limited to what is illustrated in the drawings and described in the specification.

What is claimed is:

1. A multifunctional handle for an agricultural combine comprising:

a. a crescent control region with an upper control area and a lower control area, said control areas having a plurality of control switches, said plurality of control switches on the upper control area being capable of being controlled by an operator's thumb after said thumb is moved in a clockwise fashion and said plurality of control switches on the lower control area being capable of being controlled by the operator's thumb after said thumb is moved in a counter-clockwise fashion;

b. a palm grip affixed to the crescent control region, said palm grip for receiving an operator's right palm;

c. a finger rest affixed to the palm grip, said finger rest for receiving an operator's fingers; and d. a support tube connecting the palm grip to a control console, said support tube being capable of moving relative to the control console, wherein the palm grip and the finger rest descend in a tapered fashion from the crescent control area, said taper in a range of 30 to 45 degrees from a horizontal line from the crescent control area whereby the operator's palm and fingers are positioned in an ergonometric position.

2. The multifunctional handle for an agricultural combine described in claim 1, wherein the plurality of switches in the upper control area comprise:

a. a two way toggle switch for controlling the motion of an unload tube on the agricultural combine;

b. an on/off switch for activating the unload tube on the agricultural combine; and c. a switch guard means proximal to the on/off switch for activating the unload tube, whereby the operator may manipulate the two way toggle switch for controlling the motion of an unload tube and the on/off switch by the moving operator's thumb in a clockwise manner.

3. The multifinctional handle for an agricultural combine described in claim 2, wherein the switch guard means further comprises a switch guard ridge positioned between the two way toggle switch and the on/off switch for activating the unload tube, whereby the operator's thumb is prevented from inadvertently contacting said on/off switch for activating the unload tube.

4. The multifunctional handle for an agricultural combine described in claim 2, wherein the switch guard means further comprises a raised, bevelled region surrounding the on/off switch for activating the unload tube, whereby the operator's thumb is prevented from inadvertently contacting said on/off switch for activating the unload tube.

5. The multifinctional handle for an agricultural combine described in claim 3, wherein the plurality of switches in the lower control area comprise:

a. a four way toggle switch for reel control;

b. a header resume switch; and c. a two way toggle switch for controlling reel speed, whereby the operator may manipulate the header resume switch, four way toggle switch for reel control and two way toggle switch for controlling reel speed by moving the operator's thumb in a counter-clock wise manner.

6. The multifunctional handle for an agricultural combine described in claim 5, wherein the crescent control region further comprises a thumb rest area positioned between the upper control area and lower control area.

7. The multifunctional handle for an agricultural combine described in claim 6, the thumb rest area further comprises a thumb ledge, whereby the operator's thumb can be placed assisting in the positioning of the thumb.

8. The multifinctional handle for an agricultural combine described in claim 6, wherein the thumb rest area has a dimple, whereby the operator's thumb can be positioned in the thumb rest area.

9. The multifunctional handle for an agricultural combine described in claim 5, wherein the crescent control region further comprises a middle control area positioned between the upper control area and lower control area, said middle control area having a two way toggle switch for raising/lowering a header, a counter clock wise header lateral control switch and a clock wise header control switch.

10. The multifunctional handle for an agricultural combine described in claim 9, wherein the two way toggle switch for raising/lowering the header further comprises a dimple, whereby the operator can position the operator's thumb.

11. The multifunctional handle described in claim 10, wherein the finger rest further comprises a mechanical neutral trigger switch.

12. In a combine harvester, said combine having a header having a reel, said header operationally connected to a threshing and separating system, said threshing and separating system operationally connected to a grain bin, said grain bin operationally connected to a grain tank unload tube, said combine having a cab with a control console, an operator's chair and said control console having a support tube capable of moving relative to the control console, the improvement comprising a multifunction handle affixed to the support tube, said handle further comprising:

a. a crescent control area with an upper control area, a thumb rest area and a lower control area, said thumb rest area positioned between the upper control area and lower control area, said thumb rest area having a thumb ledge for receiving the operator's thumb;

b. said upper control area and lower control area having a plurality of control switches; and c. a palm grip and a finger rest descending in a tapered fashion from the crescent control area, said taper in a range of 30 to 45 degrees from a horizontal line from the crescent control area whereby the operator's palm and fingers are positioned in an ergonometric position.

13. The improvement described in claim 12, wherein the plurality of switches in the upper control area comprises:

a. a two way toggle switch for controlling the motion of an unload tube on the agricultural combine;

b. an on/off switch for activating the unload tube on the agricultural combine; and c. a switch guard ridge positioned between the two way toggle switch and the on/off switch for activating the unload tube, whereby the operator's thumb is prevented from inadvertently contacting said on/off switch for activating the unload tube and whereby the operator may manipulate the two way toggle switch for controlling the motion of an unload tube and the on/off switch by the moving operator's thumb in a clockwise manner.

14. The improvement described in claim 13 wherein the plurality of switches in the lower control area comprise:

a. a four way toggle switch for reel control;

b. a header resume switch; and c. a two way toggle switch for controlling reel speed, whereby the operator may manipulate the header resume switch, four way toggle switch for reel control and two way toggle switch for controlling reel speed by moving the operator's thumb in a counter-clock wise manner.

15. The improvement described in claim 14, wherein the finger rest further comprises a mechanical neutral trigger switch.

16. The improvement described in claim 15, wherein the upper control area is lower than the thumb rest area, whereby the operator's thumb can differentiate the upper control area from the thumb rest area.

17. The improvement described in claim 16, wherein the lower control area is lower than the thumb rest area, whereby the operator's thumb can differentiate the lower control area from the thumb rest area.

* * * * *